United States Patent [19]

Gange

[11] 4,121,130

[45] Oct. 17, 1978

[54] CATHODE STRUCTURE AND METHOD OF OPERATING THE SAME

[75] Inventor: Robert Allen Gange, Belle Mead, N.J.

[73] Assignee: RCA Corporation, New York, N.Y.

[21] Appl. No.: 784,365

[22] Filed: Apr. 4, 1977

Related U.S. Application Data

[63] Continuation-in-part of Ser. No. 737,098, Oct. 29, 1976, abandoned.

[51] Int. Cl.[2] ..... H01J 1/46; H01J 21/10

[52] U.S. Cl. ..... 313/302; 313/338; 313/409; 313/415

[58] Field of Search ..... 313/302, 304, 338, 351, 313/410, 411, 415, 416, 409

[56] References Cited

U.S. PATENT DOCUMENTS

| | | | |
|---|---|---|---|
| 2,847,597 | 8/1958 | Bowie | 313/411 |
| 3,740,603 | 6/1973 | Kuhn | 313/410 |
| 3,935,500 | 1/1976 | Oess et al. | 313/302 |

*Primary Examiner*—Saxfield Chatmon, Jr.
*Attorney, Agent, or Firm*—E. M. Whitacre; G. H. Bruestle; G. E. Haas

[57] ABSTRACT

An insulating substrate is provided with a plurality of discrete electrode pads on a surface thereof. A thermionic line cathode, e.g., a directly heated filament, is positioned to one side of the substrate surface and extends across a surface of each one of the electrode pads. An apertured electrode is positioned in spaced relation to the cathode in a direction away from the surfaces of the electrode pads. The apertured electrode may include a single slit-shaped aperture or a plurality of colinear apertures. The structure may also include a pair of spaced parallel filter plates whose surfaces are disposed in parallel relation to the longitudinal axis of the line cathode and in orthogonal relation to the surfaces of the electrode pads. The filter plates function to collimate the electron flow emitted from the cathode.

26 Claims, 18 Drawing Figures

CATHODE STRUCTURE AND METHOD OF OPERATING THE SAME

BACKGROUND OF THE INVENTION

This application is a continuation-in-part of application, Ser. No. 737,098, now abandoned, filed Oct. 29, 1976.

This invention relates to a cathode structure, and particularly to such a structure in which a line cathode is employed.

Cathode structures are well known in the art. In simplest form, the structure includes a cathode, i.e., source of electrons, and a plurality of electrodes in spaced relation to the cathode. The electrodes are provided with appropriate electrical potentials so as to control the flow of electrons emitted by the cathode. A thermionic cathode requires additional structure to heat it to a sufficient temperature so as to produce electron emission.

A conventional cathode structure is shown in U.S. Pat. No. 3,772,554 entitled, "INLINE ELECTRON GUN," issued to R. Hughes on Nov. 13, 1973. This type of cathode structure employs three discrete cathodes and is widely used in color picture tubes. Although this structure is widely used, it suffers from several disadvantages. One problem is that the control grid, i.e., the first grid in front of the cathodes, must be carefully aligned with each one of the cathodes. However, due to the free standing nature of this control grid, commonly identified as the G1 grid plate, alignment is a formidable task. Alignment is further complicated by the fact that the three cathodes which are included in the gun may themselves not lie in a single plane. Also, the heat generated by each of the cathodes may be sufficiently great so as to affect the careful alignment by causing slight movement of the G1 grid with respect to one or more of the cathodes or to other grids.

The disadvantages of the conventional cathode structure become even more serious when a longer cathode source is employed. For example, in the case of a line source of electrons which extends over a distance greater than that of the three cathodes, the alignment and heat problems increase with the length of the line source. Such a line source would be particularly desirable for use as the cathode in a large area flat cathodoluminescent display device. In one such structure, the line source would be required to emit electrons selectively along its length. That is, the cathode line source would function as a plurality of discrete sources, each of the sources representing a small segment along the length of the line source. The electrons emitted from the source would then be guided to a phosphor screen so as to form a display.

SUMMARY OF THE INVENTION

A cathode structure includes an insulating substrate having a plurality of discrete electrode pads on a surface thereof. A thermonic cathode is positioned to one side of the surface. The cathode extends across a surface of each one of the electrode pads such that separate portions of the cathode are associated with different ones of the electrode pads. An apertured electrode is positioned in spaced relation to the cathode and the electrode pads.

DETAILED DESCRIPTION OF THE INVENTION

Figure 1:
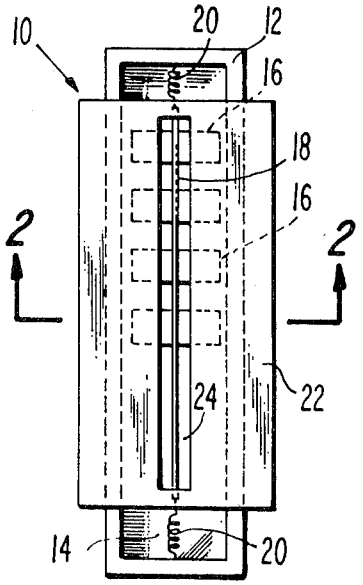
FIG. 1 is a plan view showing one form of a cathode structure of the present invention.
Figure 2:
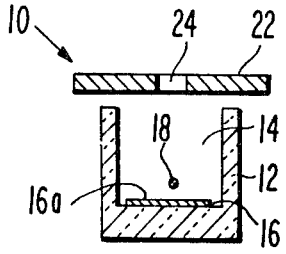
FIG. 2 is a sectional view taken along line 2—2 of FIG. 1.
Figure 3:
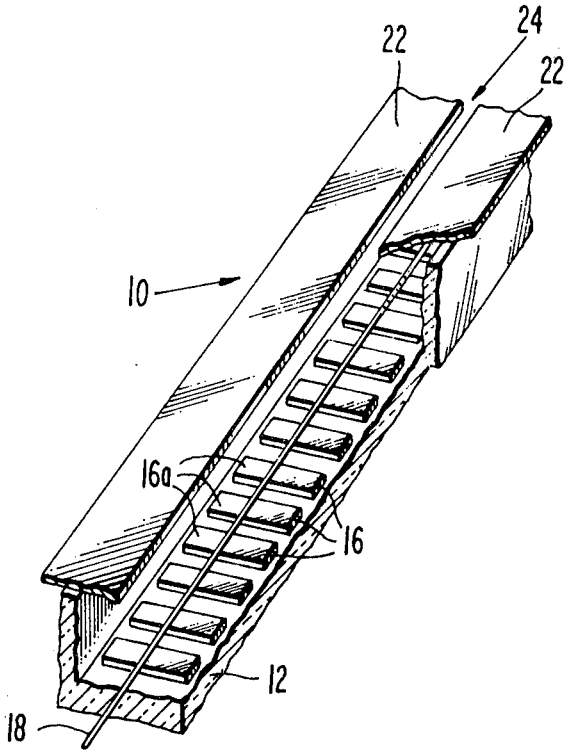
FIG. 3 is a partially broken away perspective view showing the cathode structure of FIGS. 1 and 2.

Referring initially to FIGS. 1–3, one form of a cathode structure of the present invention is generally designated as 10. The cathode structure 10 includes an electrically insulating substrate 12, such as quartz, which includes a cavity 14. The surface at the bottom of the cavity 14 includes a plurality of discrete electrode pads 16. It is preferable that each of the electrode pads 16 includes a surface **16*a* which is coplanar with the surfaces 16*a* of the other electrode pads 16. Each of the electrode pads 16** may comprise a layer of tantalum. The thickness of the layer of tantalum is not critical; typical thicknesses are 3000A to 5000A.

A filament 18, also referred to as a cathode, is suspended in the cavity 14 and extends across the surfaces **16*a* of the pads 16 such that separate portions along the length of the filament 18 are associated with different ones of the electrode pads 16. Typically, the filament length is in the range of from about 1cm to about 1 meter. The filament 18 may be a directly heated filament such as a tungsten body which has been cataphoretically coated with an emissive carbonate. A suitable emissive carbonate may comprise about 13% $CaCO_3$, 31% $SrCO_3$ and 56% $BaCO_3$. The diameter of the filament 18, including the emissive coating, is about 0.25mm. The filament 18 is maintained in place in the cavity 14 by applying tension to both ends of the filament through springs 20. The springs 20 may be composed of 100 micron diameter Haynes alloy #25. The springs 20** can be preset to a tension of 0.38kg thereby placing a tensile strength of $4.7 \times 10^9$ dynes/cm$^2$ (68,000 psi) on the filament.

An electrode 22, including an aperture 24 therein, is positioned in spaced relation to the cathode 18 with the cathode 18 being included between the electrode pads 16 and the apertured electrode 22. The aperture 24 is in the form of a single slit. The electrode 22 may be any good electrically conductive material which can be conveniently worked. For example, one such apertured electrode 22 may comprise nickel plated beryllium-copper. In relative terms, the ratio of the spacing between the apertured electrode 22 and the cathode 18 to the spacing between the cathode 18 and the electrode pads 16 is typically at least 10:1. For example, in one embodiment, the distance between the cathode 18 and the electrode pads 16 is $100 \pm 25\mu m$ and the distance between the cathode 18 and the apertured electrode 22 is $2500 \pm 25\mu m$.

In the operation of the cathode structure 10 of the present invention, the cathode 18 is maintained at an elevated temperature, e.g., 760° C, whereby electron emission occurs. When electron transmission through the aperture 24 is desired, the cathode 18 and the electrode pads 16 are maintained at ground voltage, hereinafter defined as 0 volts, while the apertured electrode 22 is maintained at values which range from about +10 volts d.c. to about +100 volts d.c., depending upon the specific dimensions and the desired level of maximum emission. Under these conditions, current flows through the apertured electrode 22 along the entire cathode length. This is considered the cathode "on" state. Electron transmission through the apertured electrode 22 can be simply controlled by changing the electrical potential at one or more of the electrode pads 16, i.e., by making the electrode pad 16 negative with respect to the cathode 18. For example, with the apertured electrode 22 at ±100 volts d.c., an electrode pad 16 at about −90 volts d.c. causes electrons emitted at the cathode 18 to be trapped there. This is considered the cathode "off" state. Generally, the cutoff voltage is of the same order of magnitude as the voltage applied to the apertured electrode 22. The action of the electrode pads in the control of the cathode is such that the electrode pads 16 can also be referred to as control pads 16.

In the cathode structure 10, each pad 16 is in fixed position with respect to the cathode 18 so that the control described above can be achieved by suitably applying the desired electrical potential to one or more control pads. Consequently, the cathode, i.e., the continuous filament, is effectively transformed into a plurality of small cathodes, each being controlled by a single control pad associated therewith. The control pads can be photolithographically determined and are deposited on a thermally stable insulating substrate so that their alignment with respect to the entire cathode and/or aperture can be accurately and simply obtained. As a result, the control pads are also aligned with each of the small cathodes which are included in the cathode. In this structure, it is important to note that the control pads, which are shown located in back of the cathode, function as the equivalent of the conventional control grid which is typically located in front of the cathode. That is, a control grid in a conventional electron gun and the control pads in the structure of the present invention both control the electron flow from the cathode. However, there is a significant difference; the cathode structure shown in FIGS. 1-3 greatly minimizes the alignment problems inherent in a conventional cathode structure.

It should also be noted at this time that the control mode previously described is rather unexpected. That is, in the cathode structure of the present invention, increasing the negative potential on an electrode located in back of the cathode causes the aperture current to decrease. Generally, the expected result would be that, increasing the negative potential on an electrode located in back of the cathode would cause the aperture current to increase due to the electrons emitted by the cathode being repelled by the negative potential of the electrode.

This unexpected control behavior of the cathode structure of the present invention can be explained by referring to the electrical potential contours present therein. These electrical potential contours are shown diagrammatically in FIGS. 4 and 5 with the use of a rubber model. The use of a rubber model to depict potential contours is discussed in *Electron Optics and the Electron Microscope,* Zworykin et al., John Wiley, New York, pp 418–442 (1945).

Figure 4:
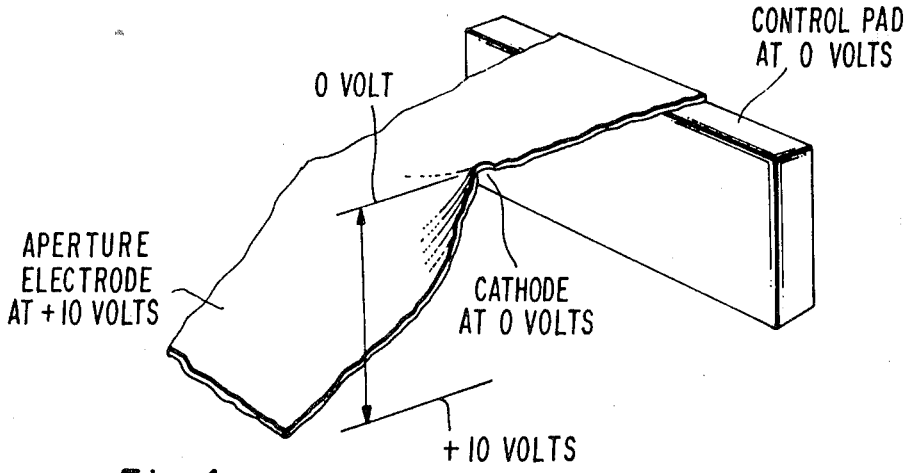
FIGS. 4 and 5 are diagrammatic representations showing electrical potential contours present in the cathode structure of the present invention during on and off operation.
Figure 5:
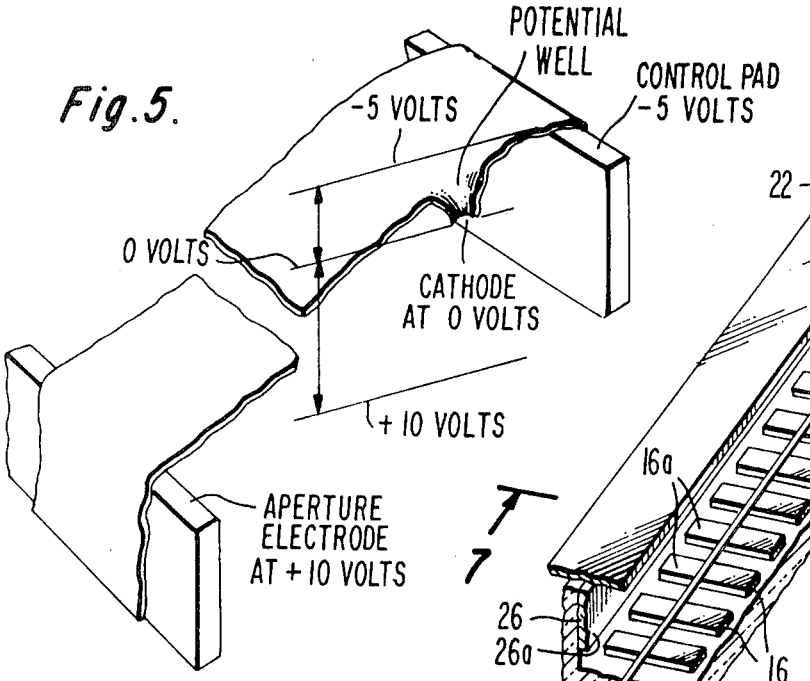

Referring now to FIG. 4, it can be seen that, in the "on" state with the cathode and the control pads at ground voltage (0 volts), the electrical potential contour is such that the electrons emitted at the cathode are attracted toward, and then pass through the apertured electrode. However, referring now to FIG. 5, it can be seen that, in the "off" state, with the control pad sufficiently negative with respect to the cathode (−5 volts d. c.), the electrical potential contour is such that electrons emitted at the cathode are circumscribed by a potential well. The potential well is of sufficient magnitude such that electrons emitted at the cathode are substantially prevented from leaving the cathode.

It should be noted that there is one condition that must be satisfied in order to allow the above-described "off" state to occur. The necessary condition is that the cathode, at zero potential, must be placed sufficiently close to the negatively biased control pad such that the region of space in which it is located would otherwise be negative if the cathode were absent. When this condition is satisfied, the negatively biased control pad produces a potential minimum localized about the cathode which is maintained at ground voltage, i.e., 0 volts d.c. Thus, as long as this condition is satisfied, spacings between the elements and voltages can be freely varied while maintaining the previously described "off" and "on" states.

The cathode structure of the present invention allows modulation to be achieved in addition to the more basic "on" and "off" states. For example, pulse width control is one convenient means to vary the amount of electrical charge which passes through the apertured electrode. In pulse width control, the "on" state time of the cathode is varied in accordance with the desired charge variation. In this form of charge control, increasing the "on" time increases the amount of charge which passes through the apertured electrode. Conversely, decreasing the "on" time of the cathode decreases the charge which passes through the apertured electrode. It should be noted that the "on" state emission is quite uniform because of the uniform cathode-to-aperture spacing and space charge effects.

Figure 6:
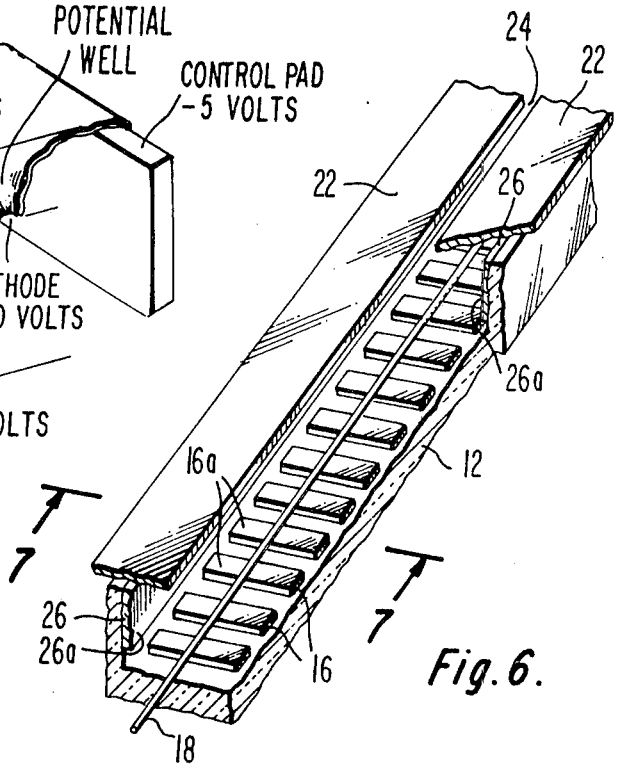
FIG. 6 is a partially broken away perspective view showing a variation of the cathode structure shown in FIGS. 1–3.
Figure 7:
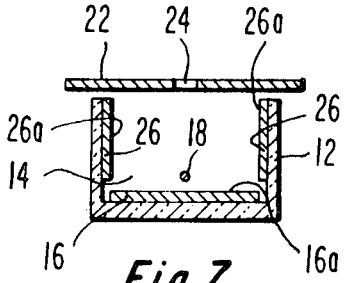
FIG. 7 is a cross sectional view of the cathode structure of FIG. 6 taken along line 7—7.
Figure 8:
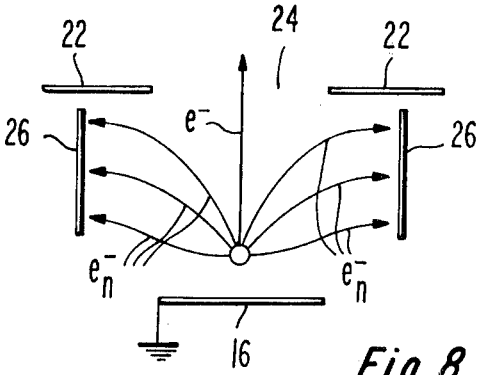
FIG. 8 is a diagrammatic representation showing electron collimation provided by the cathode structure of FIGS. 6 and 7.

A variation of the previously described cathode structure is shown in FIGS. 6 and 7. The structure is substantially the same as the structure previously described except it includes two spaced parallel filter plates 26. The filter plates 26 are disposed on the walls of the cavity 14 and include surfaces 26a which are in orthogonal relation to the surfaces 16a of the control pads and in parallel relation to the longitudinal axis of the cathode 18. In one convenient embodiment, the filter plates may be of the same material as the control pads 16. In operation of the structure, shown in FIGS. 6 and 7, the filter plates 26 can be maintained at a slight positive potential, e.g., +5 volts d.c. with respect to the ground potential (0 volts) of the cathode 18. With these operating parameters, the filter plates 26 serve to remove noncollimated electrons ($e_n$ ) from the apertured electrode 22, as shown diagrammatically in FIG. 8. Alternatively, the filter plates may be operated with a negative potential thereby enhancing focus of the beam through the apertured electrode (not shown). It should be noted that the voltage on the filter plates 26 can be adjusted in order to achieve a specific focus or collimation of the extracted beam. This control may be useful in matching the cathode structure to the structure employed to guide the electrons to the display screen.

It should be noted that, in the previously described cathode structure, shown in FIGS. 6 and 7, the high cathode activation and operating temperature, 1100° C and 760° C respectively, require a careful choice of filter plate and substrate material. Also, for reasons which will be discussed later, for improved cathode operation, it is desirable that the electrical resistively of the filter plate be low, i.e., about 0.1 ohms/square. Although, as previously described, tantalum was employed for the control pads, such a material when employed for the filter plates may not result in optimum cathode operation due to relatively high electrical resistivities. One filter plate material which exhibits the desirable low electrical resistivity and thermal compatability includes a 2500A thick tantalum layer employed as a buffer layer upon which is disposed a conductive material which comprises 95% molybdenum and 5% steatite. The conductive material is fired at 1300° C in a water saturated 10% forming gas atmosphere. The resulting conducting layer has a resistivity of about 0.1 ohms/square.

Figure 9:
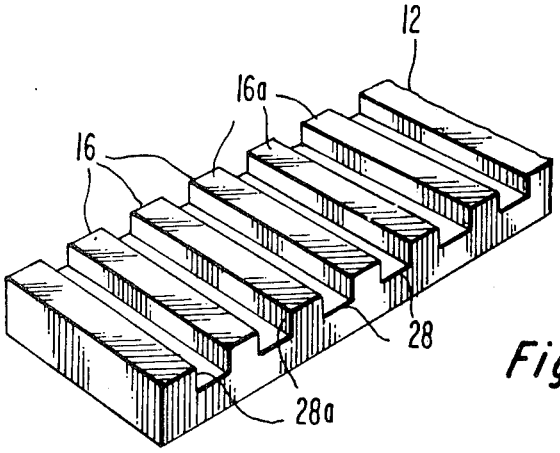
FIGS. 9 and 10 are perspective views showing portions of other variations of the cathode structure of the present invention.

Generally, in any cathode structure of the present invention, in order to maintain control of the cathode through each of the discrete control pads, it is desirable to ensure that no deposits from the emissive cathode form electrically conductive paths between adjacent control pads. These evaporative deposits are generally formed in the operation of oxide cathodes. One means for preventing the formation of these conductive paths is to provide grooves 28 in the substrate surface between adjacent control pads 16, as shown in FIG. 9. The grooves 28 establish discontinuities between adjacent electrode pads 16. Grooves 28 having walls 28a which are at right angles to the surfaces 16a of the electrode pads 16 are preferable since such grooves offer strong resistance to conductive paths forming between adjacent control pads. Generally, I have found grooves 28 in the range of from about 0.13mm to about 0.25mm in depth to be satisfactory.

Figure 10:
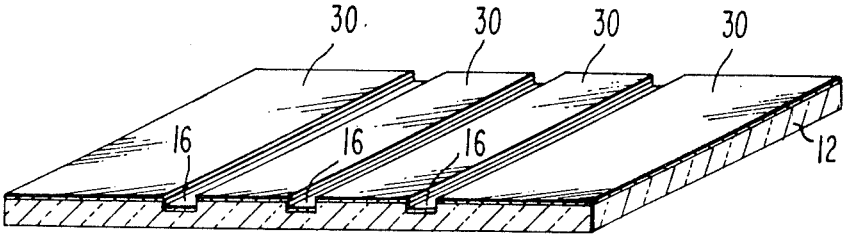

In some instances, I have found that an undesirable interaction occurs between adjacent electron beamlets formed by control pads along the cathode length. This undesirable interaction is due to the electrical potential of one control pad influencing the region of an adjacent control pad. One means for reducing this undesirable interaction is to dispose isolation electrodes 30 between the control pads 16, as shown in FIG. 10. It is desirable to recess the control pads 16 with respect to the isolation electrodes 30 so as to prevent electrical shorts from developing between the isolation electrodes 30 and the control pads 16. As a result of the recessing, the isolation pads 30 are closer to the cathode (not shown) than the control pads.

In operation of the structure shown in FIG. 10 the isolation electrodes 30 are negatively biased with respect to the cathode, e.g., −30 volts d.c., thereby interspersing negative potential barrier regions along the cathode length. This negative potential superposes with the potential which circumscribes the cathode so that the net potential is transformed into alternating segments of higher and lower field intensity along the length of the cathode. In this way, the control pads 16 are effectively isolated from each other by regions of approximately constant field intensity created by the isolation electrodes 30. These alternating segments of negative potential along the length of the cathode serve to decouple the adjacent electron beamlets which are extracted from the cathode.

Figure 11:
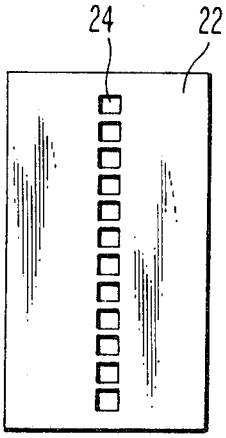
FIGS. 11 and 12 are plan views showing variations of the apertured electrode in the cathode structure of the present invention.
Figure 12:
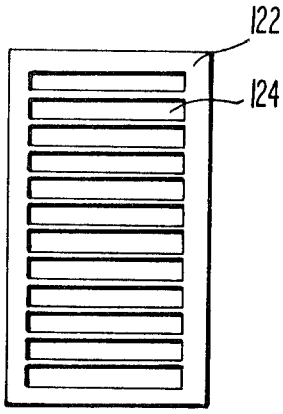

In addition, although the apertured electrode 22 has been shown as including a single continuous slit 24, variations are possible. In every variation, however, it is necessary that the apertured electrode be capable of providing the appropriate contours of positive potential relative to the cathode so that electron extraction can occur. For example, the apertured electrode 22 may include a plurality of substantially co-linear apertures 24, as shown in FIG. 11. Or, the apertured electrode may be defined by a plurality wires, as shown in FIG. 12. Thus, the apertured electrode may take the form of any electrically conductive material which includes apertures through which electrons can pass.

Figure 13:
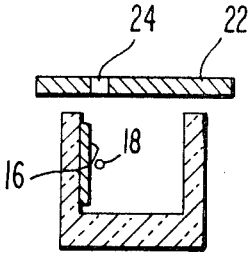
FIG. 13 is a sectional view, taken as in FIG. 2, showing another form of the cathode structure of the present invention.

Also, although the previously described cathode structure included control pads which were disposed to the side of the cathode away from the apertured electrode (FIGS. 1-3, 6 and 7), variations are possible. In every variation, however, it is necessary that the relative spacing and orientation of the elements be such that the control pads are capable of creating a potential well around the cathode. For example, in the cathode structure shown in FIG. 13, the control pads 16 are positioned to one side of the cathode 18, but closer to the apertured electrode 22.

In order to provide substantially uniform current along the length of the cathode in the previously described structures, it is necessary that the potential difference between the cathode and the apertured electrode be substantially uniform along the length of the cathode. However, since, as previously described, the cathode is heated by passing a current therethrough, a potential gradient appears across the length of the cathode. This potential gradient is undesirable because it alters the value of the extraction potential along the line cathode, and therefore, the magnitude of the extracted current.

The voltage gradient which appears across the length of the cathode can be eliminated through the use of the filter plates, described earlier, as the heating elements. This is possible because the cavity in the substrate is surrounded by the control pads and apertured electrode in such a manner as to function as an efficient oven.

Figure 14:
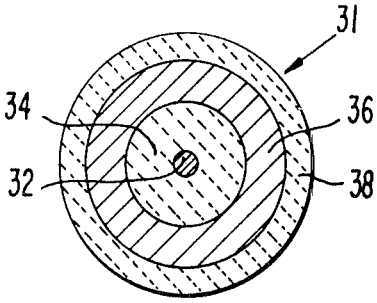
FIG. 14 is a cross sectional view of one form of an indirectly heated cathode suitable for use in the cathode structure of the present invention.

Another approach to the problem of the heater voltage gradient which appears across the length of the cathode is to employ an indirectly heated line cathode having a low cathode resistance. Such a structure, designated as 31, may include a heater element 32, such as a tungsten wire, concentrically coated with a body 34 of insulating material, as shown in FIG. 14. The body 34 of insulating material is coated with a conductive body 36 which is then coated with a layer 38 of an emissive material. The conductive body 36 functions as the means for establishing a desired electrical potential to the indirectly heated cathode. The voltage gradient which appears across the length of the heater element 32 is isolated from the emissive surface of the cathode by the insulating body 34. The indirectly heated line cathode 31 can then be considered to function as the directly heated cathode except that it exhibits substantially constant voltage along its length.

As heretofore described in the cathode structure of the present invention, where the electrode pads 16 are located behind the cathode (FIGS. 1–3), or to one side of the cathode (FIG. 13), the magnitude of voltage required to achieve cut-off is a strong function of the cathode diameter. More specifically, the larger the cathode diameter, the larger the cut-off voltage required. For some applications, this strong relationship between the cathode diameter and the cut-off voltage may be undesirable.

Figure 15:
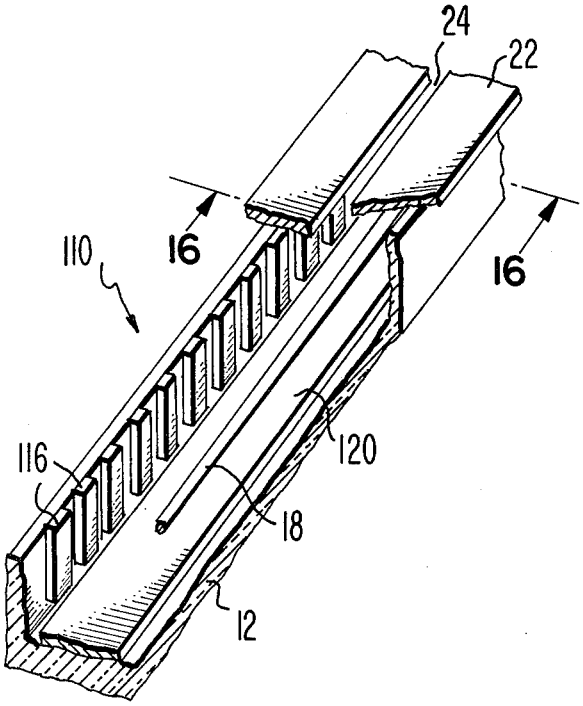
FIG. 15 is a partially broken-away perspective view showing a variation of the cathode structure shown in FIGS. 1–3.
Figure 16:
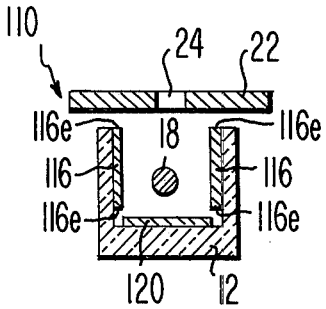
FIG. 16 is a sectional view of the cathode structure of FIG. 15 taken along line 16—16.

One variation which minimizes the dependency of the cut-off voltage on the cathode diameter is shown in FIGS. 15 and 16 and is generally designated as 110. The cathode structure 110 may include all the elements of the previously described cathode structure of FIGS. 1–3, but includes several variations thereof. The most important variation relates to the number and positioning of the electrode pads 116. In this embodiment, the line cathode 18 is sandwiched between two sets of electrode pads 116 with the electrode pads 116 of each set in respectively opposing relation. As in the previous embodiments, separate portions of the line cathode 18 are associated with different opposing pairs of the electrode pads 116. Each of the electrode pags 116 includes a pair of end portions **116*e* which extend beyond the circumference of the cathode 18. It is preferably that a conductive back plate 120 be disposed behind the cathode 18** in order to insure that the electrical potential in the region behind the cathode is well defined.

Figure 17:
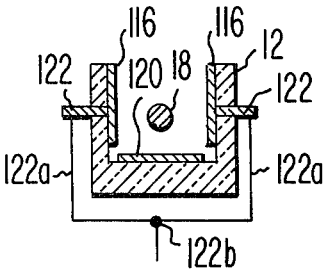
FIGS. 17 and 18 are sectional views, taken as in FIG. 16, showing exemplary electrical connections suitable for use in the cathode structure of FIGS. 15 and 16.
Figure 18:
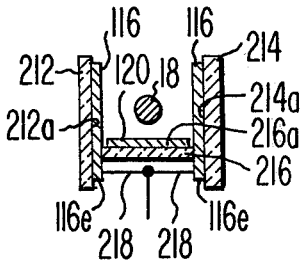

Exemplary electrical connections suitable for use in the cathode structure of the present invention are shown in FIGS. 17 and 18. It is to be noted that it is preferable for each opposing pair of the electrode pads 116 to be electrically connected to each other for reasons which will be discussed later in connection with the operation of the cathode structure. In FIG. 17, the cathode structure is provided with feedthrough contact terminals 122 which extend through the substrate 12 and contact separate ones of the electrode pads 116. The feedthrough contact terminals 122 include portions **122*a* which extend to a common input terminal 122*b*. In FIG. 18, spaced opposing insulating substrates 212 and 214 respectively provide a pair of spaced opposing insulating surfaces 212*a* and 214*a* upon which the electrode pads 116 are disposed. A third insulating substrate 216 is disposed between and in orthogonal relation to the opposing substrate 212 and 214. The third substrate 216 includes a surface 216*a* having thereon a conductive back plate 120. In this structure, contact terminals 218 are connected to electrode pad portions 116*e* which extend behind the cathode 18**.

In the operation of the cathode structure 110 of FIGS. 15 and 16, modulation potentials are applied to separate pairs of opposing electrode pads 116 in accordance with the desired cathode output. Note that this is somewhat different from the previously described cathode structure in which the modulation potentials were applied to separate ones of the electrode pads. Due to the fact that the cathode 18 of FIGS. 15 and 16 is surrounded by the electrode pads 116, for a comparable cathode diameter, relatively smaller voltages are necessary for cut-off, as compared to the previously described cathode structure of FIGS. 1–3. This situation is desirable for several reasons. One reason is that the reduced dependency of the cut-off voltage on the cathode diameter permits the use of larger diameter cathodes which require lower emission current density for a given application, and therefore, longer cathode lifetime. Also, the use of a larger diameter cathode results in lower cathode resistance, and therefore, a reduced potential gradient due to the heater voltage in a directly heated cathode.

It is to be noted that the cathode structures shown in FIGS. 16–18 can be varied. Variations may include electrode pads which extend beyond only one side of the cathode, i.e., the extraction side. Also, variations may include those previously described in connection with the cathode structure of FIGS. 1–3, 9–12 and 14. For example, as previously discussed, the apertured electrode 22 may be freely varied and, even eliminated, as long as some means are provided for extracting electron emission from the the cathode. In this connection, see the display structures shown in copending applications of: Stanley, Ser. No. 607,492, filed Aug. 25, 1975, entitled, "Flat Electron Beam Addressed Device" and of Anderson et al., Ser. No. 615,353, Filed Sept. 22, 1975, entitled, "Guided Beam Flat Display Device."

Thus, there is provided by the present invention, a cathode structure in which control pads are fixedly aligned with respect to a cathode. The cathode structure of the present invention is well suited for use as the electron source in a large area flat cathodoluminescent display device.

I claim:

1. A cathode structure, which comprises:

an insulating substrate having a plurality of discrete electrode pads on a surface thereof;

a thermionic cathode positioned to one side of said surface, said cathode extending across a surface of each one of said electrode pads in spaced relation therewith such that separate portions of said cathode are associated with different ones of said electrode pads; and an apertured electrode positioned in spaced relation to said cathode and said electrode pads.

2. A cathode structure in accordance with claim 1 in which said cathode is between said apertured electrode and said electrode pads.

3. A cathode structure in accordance with claim 2 in which said cathode comprises a line cathode.

4. A cathode structure in accordance with claim 3 in which the ratio of the spacing between said apertured electrode and said cathode to the spacing between said cathode and said electrode pads is at least about 10:1.

5. A cathode structure in accordance with claim 3 in which said electrode pads are associated with separate portions along the length of said cathode.

6. A cathode structure in accordance with claim 3 including discontinuities between said electrode pads for preventing cathode deposits from forming electrically conductive paths.

7. A cathode structure in accordance with claim 6 in which said discontinuities for preventing cathode deposits comprise grooves.

8. A cathode structure in accordance with claim 3 including at least one isolation electrode disposed between adjacent ones of said electrode pads.

9. A cathode structure in accordance with claim 8 in which said electrode pads are recessed with respect to said isolation electrodes.

10. A cathode structure in accordance with claim 3 in which said line cathode comprises a directly heated filament.

11. A cathode structure in accordance with claim 3 in which said line cathode comprises an indirectly heated filament.

12. A cathode structure in accordance with claim 3, which further comprises:

at least two spaced apart filter plates, each of said filter plates having at least one surface which is disposed in orthogonal relation to said surfaces of said electrode pads and in parallel relation to the longitudinal axis of said line cathode, said filter plates being disposed between said cathode and said apertured electrode so that electrons moving from said cathode to said apertured electrode traverse the space between said filter plates.

13. A cathode structure in accordance with claim 12 in which said filter plates are disposed on said insulating substrate.

14. A cathode structure in accordance with claim 13 in which said insulating substrate comprises quartz.

15. A cathode structure in accordance with claim 14 in which said filter plates include a buffer layer of tantalum.

16. A cathode structure in accordance with claim 15 in which a conductive layer of molybdenum-steatite is disposed on said tantalum buffer layer.

17. A method of operating a cathode structure having an insulating substrate with a plurality of electrode pads on a surface thereof, a thermionic cathode positioned in spaced relation to one side of the surface with the cathode extending across a surface of the electrode pads such that different portions of the cathode are associated with different electrode pads, and an apertured electrode positioned in a spaced relation to said cathode, the method comprising:

establishing electrical potentials at said electrode pads, said cathode and said apertured electrode with the potential at each of said electrode pads controling the magnitude of electron flow from the associated portion of said cathode through said apertured electrode.

18. A method in accordance with claim 17 in which the electrical potential at said electrode pad is switched between two values, at least one of which results in a potential well circumscribing said cathode such that electrons emitted at said cathode are substantially prevented from leaving said cathode.

19. A method in accordance with claim 18 in which another value of said electrical potential at said electrode pad causes electrons emitted by said cathode to leave said cathode and pass through said apertured electrode.

20. A method in accordance with claim 19 in which pulse width control is used to modulate the magnitude of said electron flow through said apertured electrode.

21. A method in accordance with claim 17 in which said cathode structure includes a plurality of said electrode pads and said cathode comprises a line cathode, said line cathode extending across a surface of each one of said cathode pads such that separate portions of said cathode are associated with different ones of said electrode pads, wherein the method comprises:

establishing said electrical potentials at each one of said electrodes, said cathode and said apertured electrode so as to control the magnitude of electron flow through said apertured electrode from each of said separate portions of said cathode.

22. A method in accordance with claim 21 in which said cathode is between said apertured electrode and said electrode pads.

23. A cathode structure, which comprises:

a pair of spaced opposing insulating surfaces, each of said surfaces having a plurality of discrete electrode pads thereon with said pads on said opposing surfaces in opposing relation;

a thermionic cathode positioned between said opposing surfaces, said cathode extending orthogonally across a surface of each one of said electrode pads such that separate portions of said cathode are associated with different opposing pairs of said electrode pads with at least a portion of each of said electrode pads extending beyond the circumference of said cathode; and means for extracting electron emission from said cathode, said means being disposed in spaced relation to said cathode and in adjacent relation to said portions of said electrode pads.

24. A cathode structure in accordance with claim 23 in which said means comprises an apertured electrode.

25. A cathode structure in accordance with claim 23 in which said cathode comprises a line cathode.

26. A cathode structure in accordance with claim 25 in which said cathode comprises a directly heated cathode.

* * * * *

UNITED STATES PATENT AND TRADEMARK OFFICE
CERTIFICATE OF CORRECTION

PATENT NO. : 4,121,130

DATED : October 17, 1978

INVENTOR(S) : Robert Allen Gange

It is certified that error appears in the above-identified patent and that said Letters Patent is hereby corrected as shown below:

| | |
|---|---|
| Column 3, line 41: | "±100 volts" should be --+100 volts--. |
| Column 6, line 36: | "plurality wires" should be --plurality of wires--. |
| Column 7, line 43: | "electrode pags" should be --electrode pads--. |
| Column 7, line 45: | "preferably" should be --preferable--. |

Signed and Sealed this

*Twelfth* Day of *June 1979*

[SEAL]

*Attest:*

RUTH C. MASON
*Attesting Officer*

DONALD W. BANNER
*Commissioner of Patents and Trademarks*